US007056196B2

(12) United States Patent
Numoto

(10) Patent No.: US 7,056,196 B2
(45) Date of Patent: Jun. 6, 2006

(54) WAFER POLISHER

(75) Inventor: Minoru Numoto, Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 283 days.

(21) Appl. No.: 10/433,364

(22) PCT Filed: Dec. 4, 2001

(86) PCT No.: PCT/JP01/10566

§ 371 (c)(1),
(2), (4) Date: Jun. 4, 2003

(87) PCT Pub. No.: WO02/47140

PCT Pub. Date: Jun. 13, 2002

(65) Prior Publication Data

US 2004/0018806 A1 Jan. 29, 2004

(30) Foreign Application Priority Data

Dec. 4, 2000 (JP) ..... 2000-368638
Nov. 22, 2001 (JP) ..... 2001-357808

(51) Int. Cl.
*B24B 1/00* (2006.01)

(52) U.S. Cl. ..... 451/285; 451/287; 451/397; 451/398

(58) Field of Classification Search ..... 451/41, 451/285, 286, 287, 288, 397, 398
See application file for complete search history.

(56) References Cited

U.S. PATENT DOCUMENTS 6,273,804 B1 8/2001 Numoto
6,277,010 B1 * 8/2001 Perlov et al. ..... 451/288
6,358,121 B1 * 3/2002 Zuniga ..... 451/41
6,494,774 B1 * 12/2002 Zuniga et al. ..... 451/398
6,527,624 B1 * 3/2003 Tolles et al. ..... 451/41
6,540,590 B1 * 4/2003 Kajiwara et al. ..... 451/41
6,641,461 B1 * 11/2003 Wang et al. ..... 451/41
6,663,466 B1 * 12/2003 Chen et al. ..... 451/8
6,705,932 B1 * 3/2004 Zuniga et al. ..... 451/397
6,722,965 B1 * 4/2004 Zuniga et al. ..... 451/288

* cited by examiner

*Primary Examiner*—Eileen P. Morgan
(74) *Attorney, Agent, or Firm*—Nixon Peabody LLP; David S. Safran

(57) ABSTRACT

A wafer polisher, wherein a retainer ring (28) is installed in a wafer holding head (14), a protective sheet material (52) is disposed inside the retainer ring (28), and a wafer (W) is pressed against a polishing pad (20) through the protective sheet material (52) for polishing, whereby the protective sheet material (52) can be disposed without causing wrinkles on the inner peripheral part of the retainer ring (28).

15 Claims, 6 Drawing Sheets

WAFER POLISHER

TECHNICAL FIELD

The present invention relates to a wafer polisher that polishes a wafer by means of the chemical mechanical polishing (CMP).

BACKGROUND ART

Polishing of a wafer by means of CMP is conducted in such a way that the wafer is pressed against a rotating polishing pad with a predetermined pressure while rotating the wafer and feeding a mechano-chemical polishing agent between the polishing pad and the wafer. Here, the wafer is surrounded by a retainer ring with the reverse face side of the wafer supported by a carrier (back plate) so that the wafer is pressed against the polishing pad.

In a conventional wafer polisher, however, the reverse face of the wafer is in direct contact with the hard surface of the carrier to press the wafer, and accordingly there has been a drawback that the reverse face of the wafer is damaged. Additionally, the surface precision of the carrier is transcribed onto the wafer, and hence the surface of the carrier needs to be fabricated with a high precision.

Hence, in order to solve these problems the present applicant has proposed a wafer polisher in Japanese Patent No. 3085948 in which a protective sheet integrated with the retainer ring is provided underneath the carrier (back plate). In the wafer polisher, the reverse face of the wafer is pressed by an air layer through the protective sheet, so that the direct contact of the hard surface of the carrier with the reverse face of the wafer is prevented. In this way, the reverse face of the wafer is prevented from being damaged. Additionally, it has become unnecessary to fabricate the surface of the carrier (back plate) with high precision.

In this case, as shown in FIG. 6, the protective sheet 1 is attached to a retainer ring holder 3, which is disposed to surround the carrier 2, with the peripheral part of the protective sheet 1 adhered to the retainer ring holder 3, and the retainer ring 4 is attached underneath the protective sheet 1.

However, when the protective sheet 1 and the retainer ring 4 are attached as described above, it is necessary to match the thickness of the retainer ring 4 with the thickness of the wafer W (1 mm or less), so that there occurs a drawback that the thickness of the retainer ring 4 is made to be extremely thin and accordingly the strength and durability of the retainer ring 4 are degraded.

It is preferable that the protective sheet 1 is attached uniformly without causing wrinkles across the entire sheet; however, there has been a drawback that it is difficult to attach without causing wrinkles by the above-described way of attachment.

On the other hand, a finding is obtained to indicate that polishing is possible without necessarily fixing the protective sheet 1 onto the retainer ring 4, depending on the material, thickness and the like of the protective sheet 1.

The present invention has been achieved in consideration of the above circumstances, and takes as its object the provision of a wafer polisher that permits easy attachment of the protective sheet and can ensure the strength and durability of the retainer ring.

SUMMARY OF THE INVENTION

In order to attain the above described object, a wafer polisher according to the present invention is a wafer polisher which polishes a wafer by pressing the wafer against a polishing pad through a fluid layer, the wafer polisher comprising: a wafer holding head; a retainer ring which is attached to the wafer holding head; and a sheet material which is disposed inside the retainer ring, wherein the wafer is pressed against the polishing pad through the sheet material so as to be polished.

According to the present invention, it is only needed to dispose a sheet material inside the retainer ring, depending on the material type, thickness and the like of the sheet material. For the purpose of attaching the sheet material uniformly without causing wrinkles across the entire sheet, it is recommended to attach the sheet material to the retainer ring. In any case, an effect can be obtained that the protective sheet can be easily attached.

Preferably, a fitting part is formed on an upper part of the retainer ring; the wafer holding head comprises a holder, and a part to be fitted is formed in a lower part of the holder; the retainer ring is attached to the holder by fitting the fitting part of the retainer ring into the part to be fitted of the holder; and the peripheral part of the sheet material is disposed in a stretched manner by being interposed between the fitting part of the retainer ring and the part to be fitted of the holder.

According to this configuration, the sheet material is disposed in a stretched manner on the inner peripheral part of the retainer ring with the peripheral part of the sheet material interposed between the fitting part of the retainer ring and the part to be fitted of the holder. By being thus disposed in a stretched manner, the peripheral part of the sheet material is stretched toward the periphery so that the sheet material is disposed in a uniformly stretched manner with no wrinkles across the entire surface thereof.

THE PREFERRED EMBODIMENTS FOR CARRYING OUT THE INVENTION

Detailed description is made below on the preferred embodiments of a wafer polisher according to the present invention with reference to the accompanied drawings.

Figure 1:
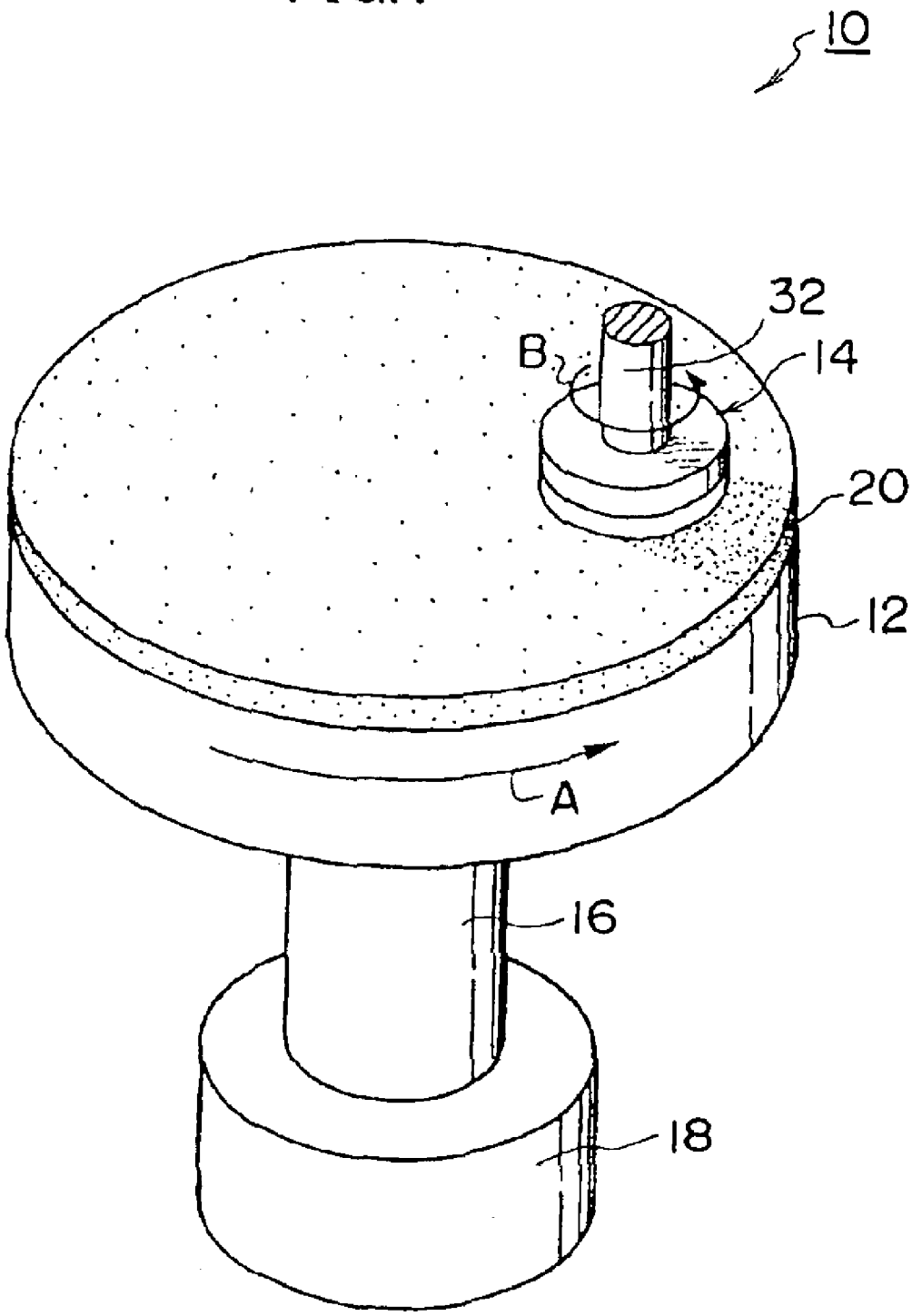
FIG. 1 is an oblique perspective view illustrating the overall structure of a wafer polisher.

FIG. 1 is an oblique perspective view showing the overall configuration of a wafer polisher 10. As shown in the drawing, the wafer polisher 10 is mainly composed of a polishing platen 12 and a wafer holding head 14.

The polishing platen 12 is formed in a disc shape, and a rotational axis 16 is connected to the center of the lower surface of the polishing platen 12. The polishing platen 12 is rotated by driving a motor 18 connected to the rotational axis 16. Additionally, a polishing pad 20 is adhered onto the upper surface of the polishing platen 12, and a mechano-chemical polishing agent (slurry) is fed onto the polishing pad 20 through a nozzle (not shown).

Figure 2:
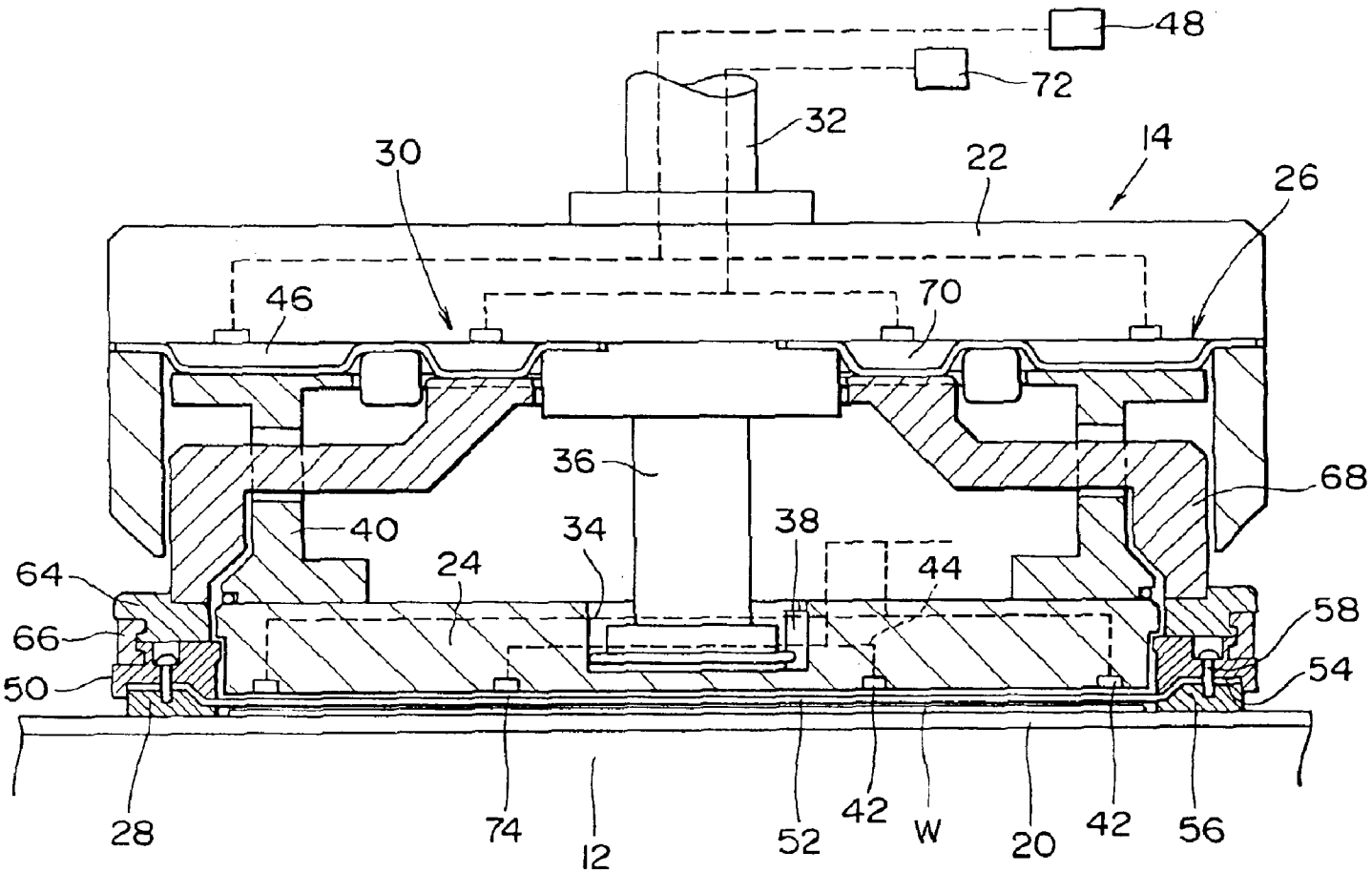
FIG. 2 is a sectional view showing the configuration of a wafer holding head.

The wafer holding head 14 is, as shown in FIG. 2, mainly composed of a head body 22, a back plate (carrier) 24, a back plate pressing device 26, a retainer ring 28, a retainer ring pressing device 30, and so on.

The head body 22 is formed in a disc shape, and a rotational axis 32 is connected to the center of the upper surface of the head body 22. The head body 22 rotates by being driven by a motor (not shown) connected to the rotational axis 32.

The back plate 24 is formed in a disc shape, and is disposed in the bottom center of the head body 22. A cylindrical receding part 34 is formed in the center of the upper surface of the back plate 24. A shank 36 of the head body 22 is fitted into the receding part 34 through a pin 38. The rotation is transmitted from the head body 22 to the back plate 24 through the pin 38.

A back plate pressing member 40 is provided on the peripheral part of the upper surface of the back plate 24. The pressing force is transmitted from the back plate pressing device 26 to the back plate 24 through the back plate pressing member 40.

An air sucking/blowing groove 42 is formed in the lower surface of the back plate 24. An airflow path 44 formed inside the back plate 24 is communicatively connected to the sucking/blowing groove 42. An air suction pump and an air supply pump are connected to the airflow path 44 through air tubes (not shown). Changing over between the air suction and the air blowing through the sucking/blowing groove 42 is made by changing over between the air suction pump and the air supply pump.

The back plate pressing device 26 is disposed on the outer peripheral part of the lower surface of the head body 22, and applies a pressing force to the back plate pressing member 40 so that the pressing force is transmitted to the back plate 24, which is connected to the back plate pressing member 40. The back plate pressing device 26 is preferably formed with an air bag 46 made of a rubber sheet that can be expanded and contracted by air charging and discharging. The air bag 46 is connected to an air supply apparatus 48 for supplying the air, and the air supply apparatus 48 is provided with a regulator (not shown) for adjusting the pressure of the air compressed and transported from a pump (not shown).

The retainer ring 28 is formed in a ring shape and disposed around the outer peripheral part of the back plate 24. The retainer ring 28 is fixed to a retainer ring holder 50, and a protective sheet 52, namely a sheet material, is disposed on the inner peripheral part of the retainer ring 28.

Figure 3:
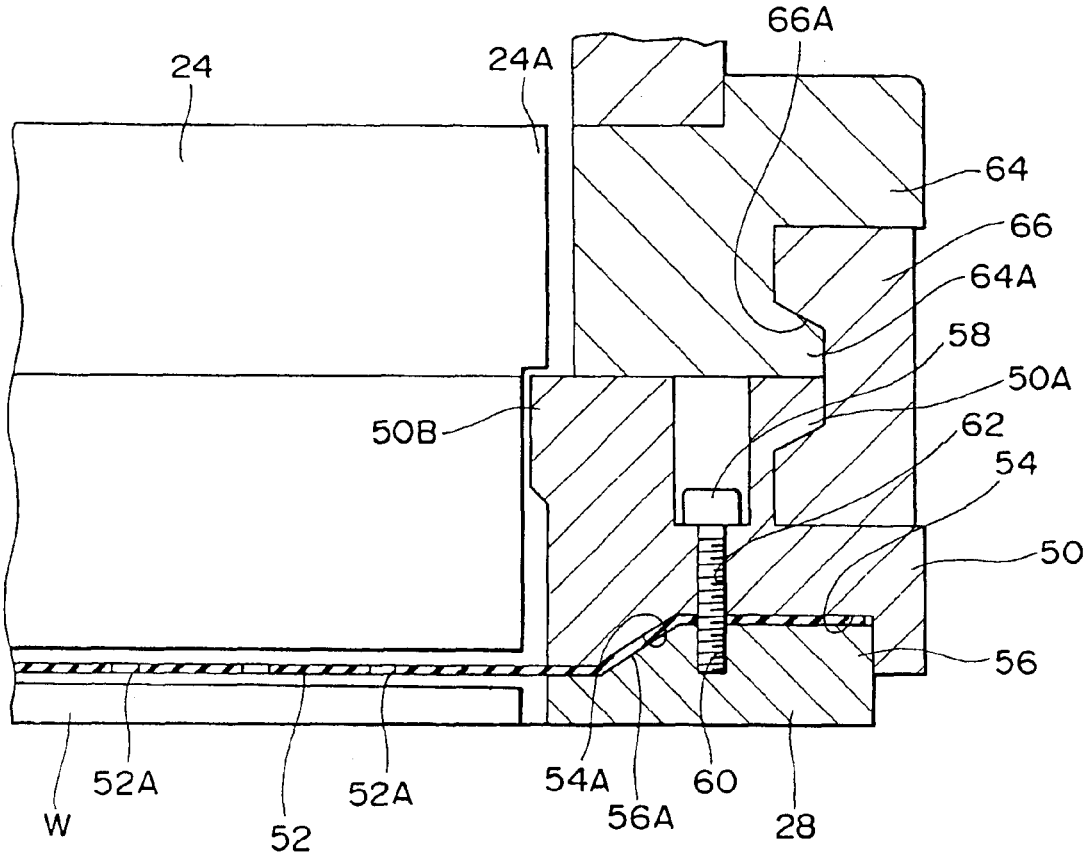
FIG. 3 is a sectional view showing the configuration of the part in which a protective sheet is interposed.

The retainer ring holder 50 is formed in a ring shape, and a ring-shaped receding part 54 is formed in the lower surface of the retainer ring holder 50 as shown in FIGS. 2 and 3. On the other hand, a projecting part 56 to fit into the receding part 54 is formed on the upper surface of the retainer ring 28; the retainer ring 28 is attached to the retainer ring holder 50 by fitting the projecting part 56 into the receding part 54 of the retainer ring holder 50.

The protective sheet 52 is formed in a circular shape, on which a plurality of holes 52A are formed as through-holes. The peripheral part of the protective sheet 52 is interposed between the retainer ring 28 and the retainer ring holder 50 so that the protective sheet 52 is disposed inside the retainer ring 28 in a stretched manner. In other words, the protective sheet 52 is formed in a thin circular shape, and is disposed inside the retainer ring 28 in a stretched manner in such a way that the peripheral part of the protective sheet 52 is caught between the projecting part 56 of the retainer ring 28 and the receding part 54 of the retainer ring holder 50 when the retainer ring 28 is attached. Such a way of being disposed in a stretched manner makes it possible to stretch the protective sheet 52 toward the periphery concurrently with the attachment thereof, so that the protective sheet 52 is uniformly disposed in a stretched manner without causing wrinkles across the entire surface thereof.

The retainer ring 28 is fixed to the retainer ring holder 50 in such a way that the projecting part 56 thereof is fitted into the receding part 54 of the retainer ring holder 50, and then the retainer ring 28 and the retainer ring holder 50 are screwed to each other with bolts 58, 58, . . . . For this purpose, screw holes 60, 60, . . . are formed with constant intervals in the retainer ring 28, and through-holes 62, 62, . . . are formed with the constant intervals in the retainer ring holder 50.

The projecting part 56 formed on the retainer ring 28 and the receding part 54 formed in the retainer ring holder 50 are made to be easily subjected to fitting together operation because the respective wall faces 54A, 56A of the inner peripheral sides thereof are formed in tapered shapes.

An air layer 74 is formed in the bottom part of the back plate 24, on which the protective sheet 52 is disposed in a stretched manner as shown in FIG. 2, in particular, between the bottom part of the back plate 24 and the protective sheet 52. A wafer W is pressed against the back plate 24 through the protective sheet 52 and the air layer 74. When air is blown from the sucking/blowing groove 42 of the back plate 24 and the back plate 24 is simultaneously pressed, the pressure in the air layer 74 is increased; when the force pressing the back plate 24 and the force pressing upward the back plate 24 on the basis of the pressure of the air layer 74 become the same in magnitude, a constant pressure is maintained.

The holes 52A formed in the protective sheet 52 work as the holes for suction when a wafer W is held and conveyed, while the holes 52A work as the air blowing holes for stripping the wafer W on completion of polishing.

The retainer ring holder 50 is attached to a ring-shaped attachment member 64 through a snap ring 66. The snap ring 66 is formed in a ring shape, and a groove 66A is formed in the inner peripheral part thereof as shown in FIG. 3. The snap ring 66 has a cut formed therein so that the snap ring 66 is formed to be extensible and contractible. The retainer ring holder 50 and the attachment member 64 are coupled and fixed to each other, by fitting the outer peripheral flange parts 50A, 64A respectively formed on the top end periphery and the bottom end periphery thereof into the groove 66A formed in the snap ring 66.

An inner peripheral flange part 50B is formed on the inner periphery of the retainer ring holder 50, and a flange part 24A formed on the outer peripheral part of the back plate 24 is fitted into the inner peripheral flange part 50B with play clearance therebetween. The air of the air layer 74 ejected from the play clearance is controlled so as to attain a condition that as described above the force pressing the back plate 24 and the force pressing upward the back plate 24 on the basis of the pressure of the air layer 74 may become the same in magnitude.

A retainer ring pressing member 68 shown in FIG. 2 is connected to the attachment member 64. A pressing force is transmitted from the retainer ring pressing device 30 to the retainer ring 28 through the retainer ring pressing member 68.

The retainer ring pressing device 30 is disposed in the central part of the lower surface of the head body 22, applies a pressing force to the retainer ring pressing member 68, and thereby presses the retainer ring 28, which is connected to the retainer ring pressing member 68, against the polishing pad 20. The retainer ring pressing member 30 is preferably formed with an air bag 70 made of a rubber sheet similarly to the case of the back plate pressing device 26. An air supply apparatus 72 for supplying the air is connected to the air bag 70, and the air supply apparatus 72 is provided with a regulator (not shown) for adjusting the pressure of the air compressed and transported from a pump (not shown).

The wafer polishing method of the wafer polisher 10 configured as described above is as follows.

First, the wafer W is held by the wafer holding head 14, and placed on the polishing head 20. In this case, the wafer W is held by sucking the air from the sucking/blowing groove 42 formed in the lower surface of the back plate 24.

Next, when air is blown from the sucking/blowing groove 42 of the back plate 24 and the back plate 24 is simultaneously pressed, the pressure in the air layer 74 is increased; when the force pressing the back plate 24 and the force pressing upward the back plate 24 on the basis of the pressure of the air layer 74 become the same in magnitude, a constant pressure comes to be maintained.

Under these conditions, the polishing platen 12 is made to rotate along the A direction shown in FIG. 1, and simultaneously the wafer holding head 14 is made to rotate along the B direction shown in FIG. 1. The slurry is then fed onto the rotating polishing pad 20 from the nozzle (not shown). In this way, the lower surface of the wafer W is polished by the polishing pad 20.

Since the plurality of holes 52A are formed in the protective sheet 52 (see FIG. 3), the air supplied from the sucking/blowing groove 42 of the back plate 24 forms the air layer 74 between the back plate 24 and the reverse face of the wafer W through the protective sheet 52, and thereby presses the wafer W against the polishing pad 20.

The force pressing the wafer W against the polishing pad 20 is applied by the air layer 74 through the protective sheet 52, and is the same in magnitude as the pressure with which the protective sheet 52 presses the wafer W, so that the airflow scarcely occurs between the protective sheet 52 and the wafer W; and even if the airflow occurs, the flowing air quantity is extremely small; and hence coagulation of the slurry does not occur. Moreover, even if the thickness of the protective sheet 52 is not uniform, there is found no adverse effect on the precision in processing of the wafer W.

In the next place, description is made on the method of disposing the protective sheet 52 in a stretched manner.

Figure 5A:
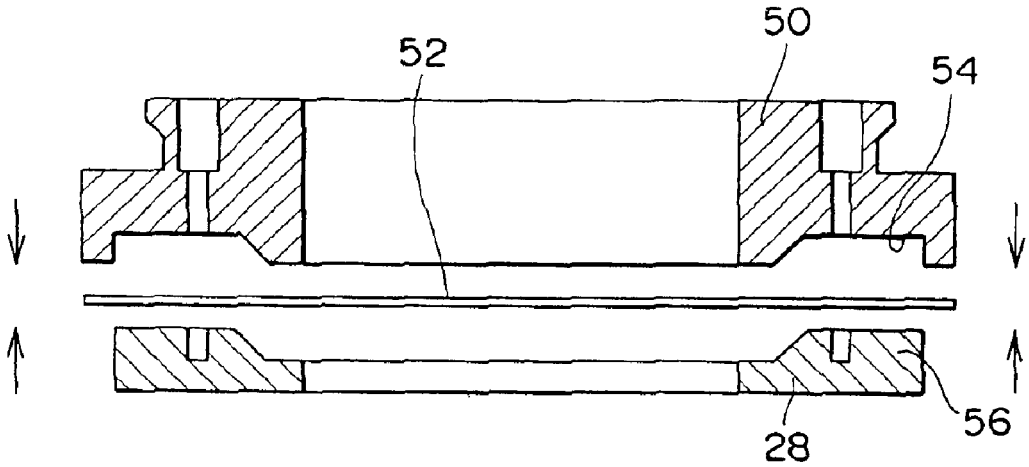
FIGS. 5(*a*) and 5(*b*) are the diagrams illustrating the attachment procedure of a retainer ring.
Figure 5B:
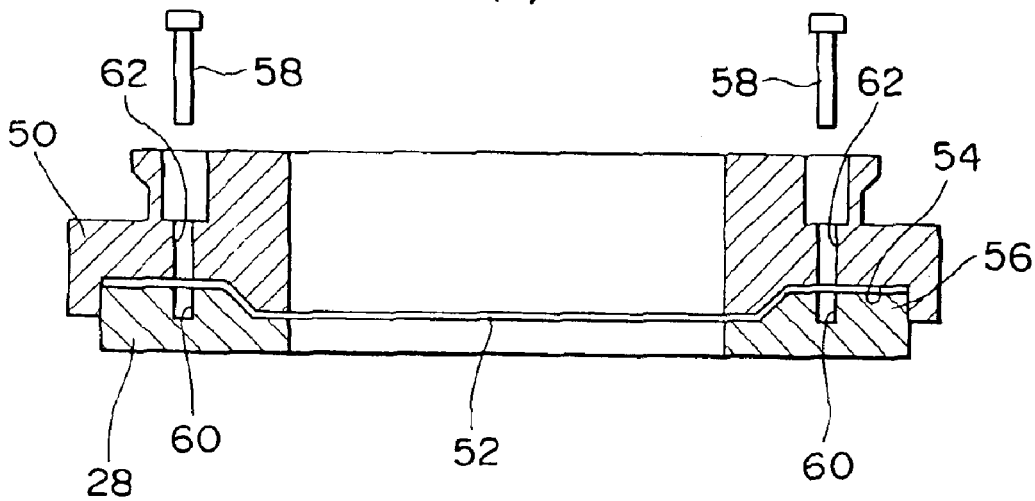
Figure 6:
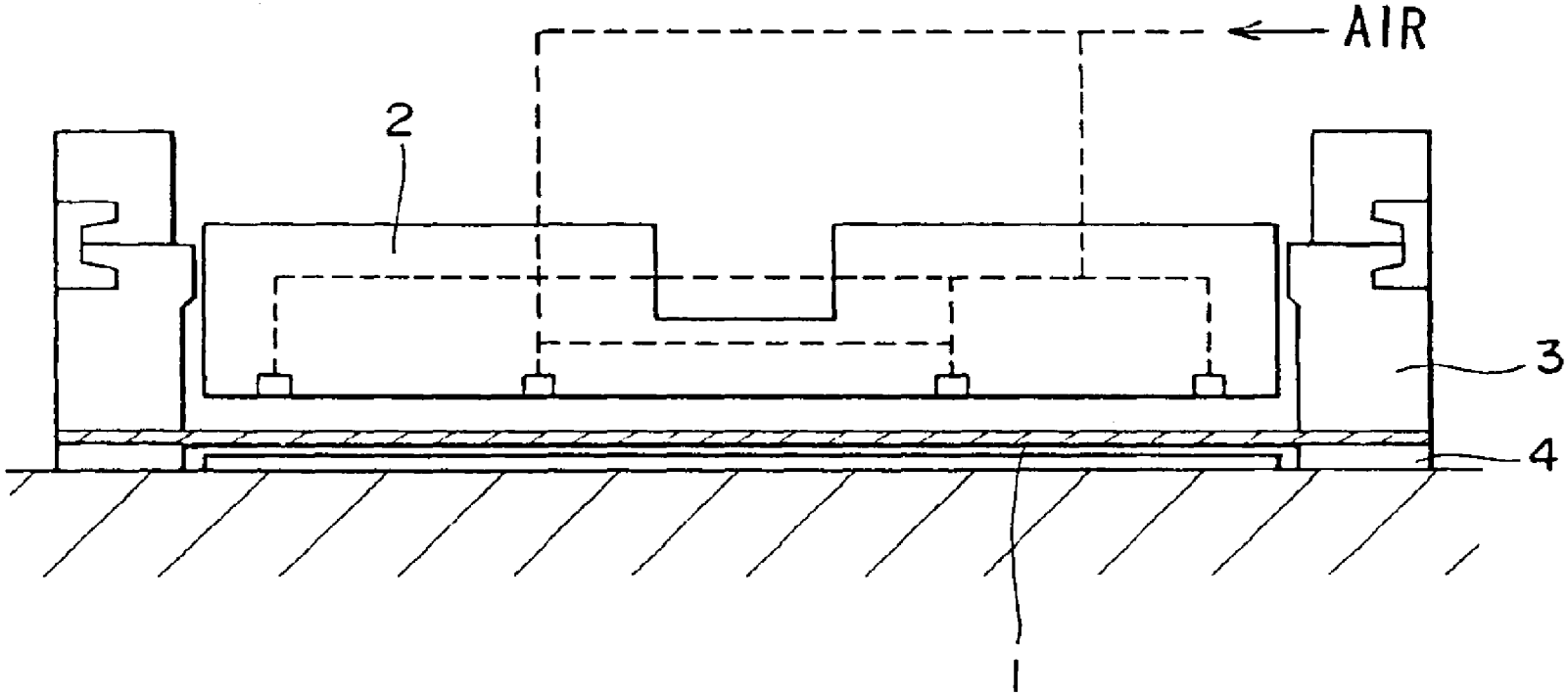
FIG. 6 is a front view showing the configuration of the relevant part of a conventional wafer holding head.

First, as shown in FIG. 5(*a*), the retainer ring 28 and the retainer ring holder 50 are separated. Then, the protective sheet 52 is arranged between the separated retainer ring 28 and retainer ring holder 50.

Next, as shown in FIG. 5(*b*), the projecting part 56 formed on the retainer ring 28 is fitted into the receding part 54 formed in the retainer ring holder 50. Herewith the protective sheet 52 is disposed inside the retainer ring 28 in a stretched manner with the peripheral part thereof interposed between the retainer ring 28 and the retainer ring holder 50. In this case, the protective sheet 52 is caught while being stretched toward the periphery so as to be disposed in a stretched manner without causing wrinkles across the entire surface thereof.

Finally, the retainer ring 28 is fixed to the retainer ring holder 50 with the bolts 58, 58, . . . , which finishes the operation of disposing in a stretched manner.

As described above, according to the wafer polisher 10 of the present embodiment, the protective sheet 52 can be easily disposed inside the retainer ring 28 with no wrinkles.

Moreover, in the wafer polisher 10 of the present embodiment, the projecting part 56 is formed on the upper surface of the retainer ring 28, so that the strength and durability of the retainer ring can be improved.

Incidentally, the retainer ring 28 and the retainer ring holder 50, with the protective sheet 52 interposed therebetween, are fixed to each other with the bolts 58 in the present embodiment, but may be bonded for fixing to each other with an adhesive agent.

Figure 4:
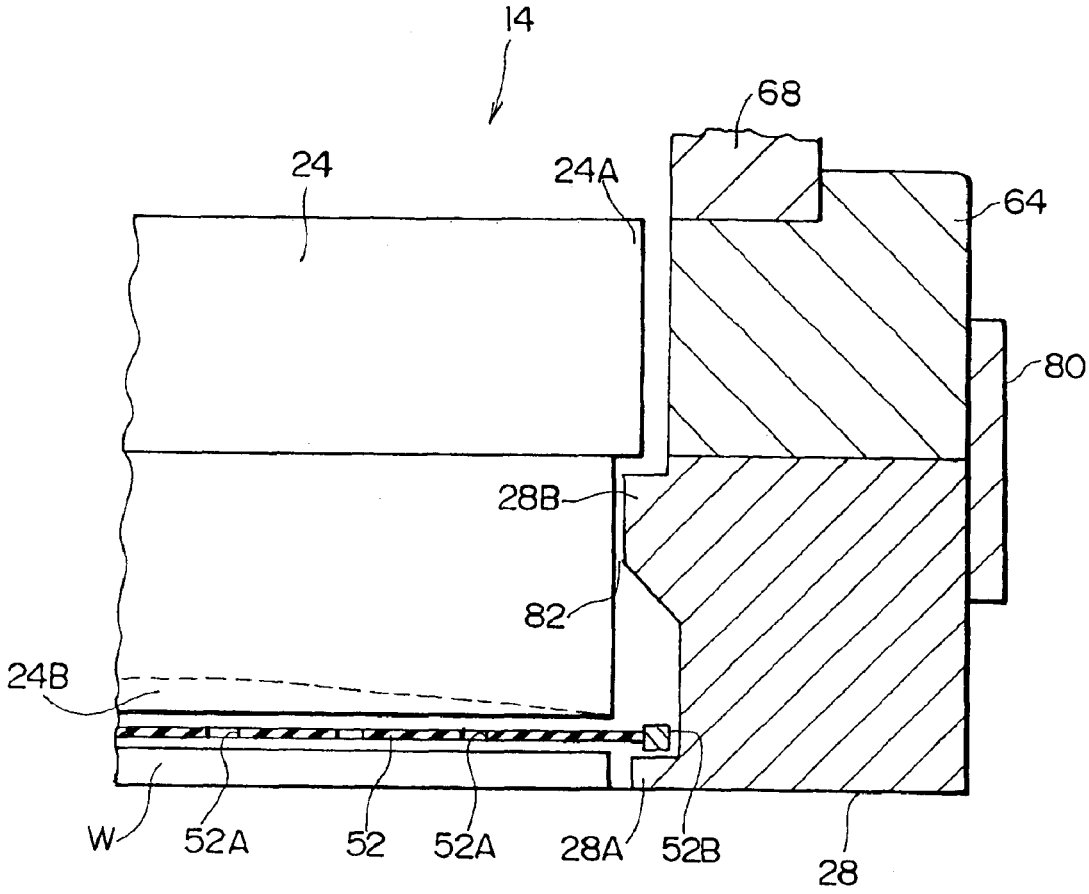
FIG. 4 is a sectional view showing another configuration of the part in which a protective sheet is interposed.

In the next place, description is made with reference to FIG. 4 on another preferred embodiment of the wafer polisher according to the present invention. Incidentally, the members that are the same as or like the members in FIGS. 2 and 3 are given like symbols, and the explanation thereof is omitted.

A retainer ring 28 is formed in a ring shape and disposed around the outer periphery of a back plate 24. The retainer ring 28 is not fixed to the retainer ring holder 50 in contrast to the configuration shown in FIG. 3, but they are formed as a one-piece body. Moreover, a protective sheet 52 as a sheet material is not disposed in a stretched manner on the inner peripheral part. Furthermore, an inwardly protruding flange part 28A is formed on the lower end of the inner peripheral part of the retainer ring 28.

The protective sheet 52 is formed in a circular shape, and a plurality of holes 52A as though-holes are formed therein. A peripheral part of the protective sheet 52 is disposed in a stretched manner on a ring shaped member 52B disposed inside the retainer ring 28, and the ring shaped member 52B is in a condition that the ring shaped member 52B can move freely in relation to the retainer ring 28. The ring shaped member 52B is made to engage with the retainer ring 28, and accordingly the ring shaped member 52B is prevented from falling off the wafer holding head 14.

In other words, depending on the plate thickness, material, and the like of the protective sheet 52, the protective sheet 52 is not necessarily fixed to the retainer ring 28, but only if the peripheral part of the protective sheet 52 is disposed on the ring shaped member 52B in a stretched manner, the protective sheet 52 is neither wrinkled nor deformed so that polishing operation is not disturbed.

As for the material and thickness of the ring shaped member 52B and the method for fixing (disposing in a stretched manner) the protective sheet 52 and the like, it is recommended to select the optimal conditions in consideration of the material, thickness, and the like of the protective sheet 52. The ring shaped member 52B is not necessarily used, and the peripheral part of the protective sheet 52 may be subjected to thermal deformation or the like to increase the thickness of the peripheral part so as to provide the function substantially similar to the function found in the configuration into which the ring shaped member 52B is incorporated.

When the wafer holding head 14 moves upward, the ring shaped member 52B is placed on the flange part 28A provided in the lower end of the inner peripheral part of the retainer ring 28 so as to engage with the retainer ring 28, so that the ring shaped member 52B is prevented from falling. In the case where the exchange frequency of the protective sheet 52 is large and the prevention of a fall of the ring shaped member 52B off the wafer holding head 14 is unnecessary, it is recommended that the retainer ring 28 is not provided with the above-described flange part 28A.

According to the configuration shown in FIG. 4, the lower surface 24B of the back plate 24 is hollow. The present invention, as already described, adopts a method in which a wafer is polished by being pressed against the polishing pad through a fluid layer so that the processing precision of the lower surface 24B of the back plate 24 does not have any effect fundamentally. Accordingly, a satisfactory polishing result can be obtained as compared to the results obtained by the wafer holding heads of conventional polishers, even if the processing precision of the lower surface 24B is somewhat poor or the lower surface 24B is not hollow.

However, even under these circumstances, the following effects can be obtained by making the lower surface 24B of the back plate 24 hollow: When a wafer is held to be conveyed, the wafer is sucked by use of the sucking/blowing groove 42; in this case, if the shape of the lower surface 24B takes a shape other than the hollow shape, for example, a projecting shape or a shape mixed with hollow and projecting parts, a satisfactory suction of the wafer W can be achieved only if the wafer W follows the particular shape of the lower surface 24B.

On the other hand, if the lower surface 24B is hollow, the depression forms a cavity part and the wafer W follows the shape of the cavity part, resulting in a satisfactory suction condition. It is recommended that the shape of the depression (the depth of the depression; the sectional shape of the depression such as an arc shape, a parabolic shape, etc.) is optimized in consideration of the configuration of the wafer holding head 14, the size of the wafer W, and the like.

The retainer ring 28 is attached to the attachment member 64 formed in a ring shape through a snap ring 80. The snap ring 80 is simply a ring shaped metallic member (a non-metallic ring is also approved), and a groove such as the groove 66A shown in FIG. 3 is not formed. The retainer ring 28 and the attachment member 64 are fixed to each other with the outer peripheral parts thereof connected to each other through the snap ring 80. Even with this type of configuration, the retainer ring 28 and the attachment member 64 can be fixed to each other so that the configuration formation becomes easy.

The retainer ring pressing member 68 shown in FIG. 2 is connected to the attachment member 64. A pressing force is transmitted from the retainer ring pressing device 30 to the retainer ring 28 through the retainer ring pressing member 68.

The configurations as explained above are the embodiments of the present invention, but the configuration of the present invention is not limited to these configurations, and can take a variety of configurations.

For example, in the above descriptions, a configuration is cited in which a wafer W is polished by being pressed against the polishing pad 20 through an airspace (an air layer) as a fluid layer; however, the fluid layer is not limited to that of this example, but the wafer W may be pressed against the polishing pad 20 through the layer of one of other gases including nitrogen gas and the like or one of liquids including water and the like.

When the liquids including water and the like are used, a too large flow rate is not preferable because of dilution of the mechano-chemical polishing agent (slurry); however, when the flow rate is small and purified water or the like is used, a major issue of dilution, contamination, and the like of the mechano-chemical polishing agent is not raised so that such a fluid can be applied.

INDUSTRIAL APPLICABILITY

As described above, according to the present invention, depending on the material type, thickness, and the like of the sheet material, it is only needed to dispose the sheet material inside the retainer ring. When the sheet material is required to be disposed uniformly without causing wrinkles across the entire sheet, it is recommended to attach the sheet material to a retainer ring. In any case, an effect can be obtained that a protective sheet can be easily disposed.

Moreover, according to the present invention, the sheet material can be easily disposed in a uniformly stretched manner by interposing the peripheral part of the sheet material between the fitting part of the retainer ring and the part to be fitted of the holder. Furthermore, by forming the fitting part in the retainer ring in a projecting shape, the strength and durability of the retainer ring itself can be improved.

What is claimed is:

1. A wafer polisher which polishes a wafer by pressing the wafer against a polishing pad by a fluid layer, the wafer polisher comprising:

a wafer holding head;

a retainer ring which is attached to the wafer holding head and is in contact with the polishing pad; and a sheet material which is disposed inside the retainer ring, a plurality of through-holes being formed in the sheet material, wherein the fluid layer is formed between the wafer holding head and the wafer, and the wafer is pressed against the polishing pad by the action of the fluid layer passed through the sheet material so as to be polished;

further comprising a back plate which is movably disposed inside the retainer ring and over the sheet material, means for exerting a force pressing the back plate toward the sheet material for increasing the pressure of said fluid layer, and means for equalizing the force pressing the back plate toward the sheet material and a back pressure acting on the back plate by the pressure of the fluid layer.

2. The wafer polisher as defined in claim 1, wherein the fluid layer is a layer of one of air and water.

3. The wafer polisher as defined in claim 2, further comprising:

a back plate disposed inside the retainer ring and above the sheet material, wherein a plurality of through-holes are formed in the sheet material, and the one of air and water leaks through a clearance defined between an outer peripheral part of the back plate and an inner peripheral part of the retainer ring to and through said through-holes in the sheet material.

4. The wafer polisher as defined in claim 3, wherein a lower surface of the back plate is hollow.

5. The wafer polisher as defined in claim 1, wherein:

a fitting part is formed on an upper part of the retainer ring;

the wafer holding head comprises a holder, and a part to be fitted is formed in a lower part of the holder;

the retainer ring is attached to the holder by fitting the fitting part of the retainer ring into the part to be fitted of the holder; and the peripheral part of the sheet material is disposed in a stretched manner by being interposed between the fitting part of the retainer ring and the part to be fitted of the holder.

6. The wafer polisher as defined in claim 5, wherein the fitting part of the retainer ring and the part to be fitted of the holder have matching tapered shapes.

7. The wafer polisher as defined in claim 5, wherein the fitting part of the retainer ring is a projecting part, and the part to be fitted of the holder is a receding part.

8. The wafer polisher as defined in claim 7, wherein the fitting part of the retainer ring and the part to be fitted of the holder have matching tapered shapes.

9. The wafer polisher as defined in claim 5, wherein the fluid layer is a layer of one of air and water.

10. The wafer polisher as defined in claim 9, further comprising:

a back plate which is disposed inside the retainer ring and over the sheet material, wherein the one of air and water leaks through a clearance defined between an outer peripheral part of the back plate and an inner peripheral part of the retainer ring to and through said through-holes in the sheet material.

11. The wafer polisher as defined in claim 10, wherein a lower surface of the back plate is hollow.

12. The wafer polisher as defined in claim 1, wherein said means for equalizing comprises a variable clearance between a peripheral edge of the back plate and a retainer ring holder through which fluid is ejected so as to equalize said pressures.

13. A wafer polisher which polishes a wafer by pressing the wafer against a polishing pad by a fluid layer, the wafer polisher comprising:

a wafer holding head;

a retainer ring which is attached to the water holding head and is in contact with the polishing pad; and a sheet material which is disposed inside the retainer ring, wherein the fluid layer is formed between the wafer holding head and the wafer, and the wafer is pressed against the polishing pad by the action of the fluid layer passed through the sheet material so as to be polished; further comprising:

a ring shaped member which is disposed inside the retainer ring and is able to move freely in relation to the retainer ring, wherein a peripheral part of the sheet material is disposed on the ring shaped member in a stretched manner.

14. The wafer polisher as defined in claim 13, wherein the ring shaped member is engageable with the retainer ring so as to be retained in the wafer holding head.

15. The wafer polisher as defined in claim 13, wherein a plurality of through-holes are formed in the sheet material.

* * * * *